US005979311A

United States Patent [19]

Kakurai et al.

[11] Patent Number: 5,979,311

[45] Date of Patent: Nov. 9, 1999

[54] STENCIL PRINTER HAVING PRINTING PAPER FEED CONTROL STRUCTURE

[75] Inventors: Osamu Kakurai; Masao Suzuki; Makoto Miyaki; Hiroyuki Sunagawa, all of Ibaraki-ken, Japan

[73] Assignee: Riso Kagaku Corporation, Tokyo, Japan

[21] Appl. No.: 09/218,454

[22] Filed: Dec. 22, 1998

[30] Foreign Application Priority Data

Dec. 24, 1997 [JP] Japan ..... 9-354808

[51] Int. Cl.[6] ..... B41L 13/00

[52] U.S. Cl. ..... 101/118; 101/485

[58] Field of Search ..... 101/116, 117, 101/118, 129, 232, 233, 242, 484, 485; 271/256, 258.01, 258.02, 265.01

[56] References Cited

U.S. PATENT DOCUMENTS

| | | | |
|---|---|---|---|
| 4,628,813 | 12/1986 | Hasegawa et al. | 101/116 |
| 5,165,338 | 11/1992 | Okazaki et al. | 101/118 |
| 5,404,805 | 4/1995 | Fujimoto et al. | 101/118 |
| 5,544,580 | 8/1996 | Takahashi | 101/118 |
| 5,632,200 | 5/1997 | Fukai | 101/114 |

FOREIGN PATENT DOCUMENTS 0 678 395 A1 10/1995 European Pat. Off. .

*Primary Examiner*—Ren Yan

*Attorney, Agent, or Firm*—Sixbey, Friedman, Leedom & Ferguson, P.C.; Donald R. Studebaker

[57] ABSTRACT

A stencil printer includes a rotary printing drum around which the stencil master is wrapped, a main motor which rotates the printing drum, a press roller which is rotatable in parallel to the printing drum in contact with the printing drum, and a pair of opposed conveyor rollers which feed a printing paper between the printing drum and the press roller so that the leading end of the printing paper meets the printing drum in a predetermined position of the printing drum. A conveyor roller motor is provided separately from the main motor and drives the conveyor rollers. A reference position sensor detects a reference position on the printing drum, a printing drum rotation detector detects rotation of the printing drum on the basis of the reference position, and a conveyor roller rotation detector detects rotation of at least one of the conveyor rollers. A conveyor roller controller controls the conveyor roller motor on the basis of the rotation of the printing drum and the rotation of the conveyor roller so that the leading end of the printing paper meets the printing drum in the predetermined position of the printing drum.

9 Claims, 11 Drawing Sheets

STENCIL PRINTER HAVING PRINTING PAPER FEED CONTROL STRUCTURE

BACKGROUND OF THE INVENTION

1. Field of the Invention

This invention relates to a stencil printer, and more particularly to paper feed control in a stencil printer in which printing papers are fed between a stencil master wrapped around a printing drum and a press roller.

2. Description of the Related Art

In a stencil printer, a stencil master is wrapped around a printing drum and the printing drum is rotated. A press roller in contact with the stencil master on the printing drum is rotated together with the printing drum and a printing paper is fed between the stencil master and the press roller by a paper feed mechanism. The printing paper is conveyed pinched between the stencil master and the press roller and ink supplied inside the printing drum is transferred to the printing paper through perforations in the stencil master.

In such a stencil printer, the printing paper must be fed between the printing drum and the press roller at a timing such that the printing paper exactly overlaps with the stencil master in a predetermined position relative to the stencil master. For this purpose, the paper feed mechanism is arranged to be constantly driven with a predetermined phase difference or a predetermined ratio of speeds relative to the printing drum, and upon starting of printing, adjustment for ensuring that the printing paper exactly overlaps with the stencil master in a predetermined position is carried out.

In conventional stencil printers, the paper feed mechanism generally comprises primary and secondary paper feed sections which are driven by the printing drum by way of a transmission mechanism such as those including gears.

The primary and secondary paper feed sections in the conventional stencil printers will be described hereinbelow.

In the primary paper feed section, printing papers stacked on a paper feed table are fed one by one for one rotation of the printing drum by a pickup roller and scraper and conveyed to the secondary paper feed section. The pickup roller and the scraper are intermittently rotated by a main motor, which drives the printing drum, by way of a paper feed clutch which is selectively engaged and disengaged on the basis of a signal from a drum position sensor which detects the angular position of the printing drum. The pickup roller and the scraper are provided with a one-way clutch and the paper feed clutch is disengaged after the primary paper feed section delivers the leading end of the printing paper to the secondary paper feed section so that the pickup roller and the scraper run free and back tension is reduced.

In the secondary paper feed section, the leading end of the printing paper fed by the pickup roller and the scraper abuts against a guide roller or a timing roller near the contact line of the guide roller and the timing roller (will be referred to as "the conveyor roller pair", hereinbelow) which are stopped and the printing paper sags. Then the conveyor roller pair are started when the printing drum is in a predetermined phase of rotation. Each roller of the conveyor roller pair is provided with a gear on each end of its shaft and the gears on the shafts of the rollers on each end thereof are in mesh with each other. The guide roller is caused to make several rotations in one direction per one rotation of the printing drum by the main motor by way of a transmission mechanism comprising gears or an endless belt, a cam, a sector gear, a one-way clutch and the like. The timing roller is rotated in the direction opposite to the guide roller driven by the guide roller. The timing roller is moved away from the guide roller after the guide roller is stopped by a mechanism including, for instance, a cam, a cam follower, a link member and a resilient member. Further, the timing roller is provided with a spring or an electromagnetic brake on one end of its shaft so that the timing roller is stopped as soon as it is disengaged from the guide roller without overshooting under inertia.

The printing paper conveyed by the conveyor roller pair is fed between the printing drum and the press roller pressed against the printing drum at a predetermined pressure and ink supplied from an ink supply section disposed inside the printing drum is transferred to the printing paper through image-wise perforations in the stencil master while the printing paper is conveyed pinched by the printing drum and the press roller.

A clamp mechanism which clamps an end of the stencil master and holds the stencil master on the circumferential surface of the printing drum is provided on the circumferential surface of the printing drum. Since the clamp mechanism projects outward in a radial direction of the printing drum, the press roller is moved between an operative position where it is in contact with the printing drum and a retracted position where it is away from the printing drum in order to prevent the clamping mechanism from interfering with the press roller.

The position of the printing paper relative to the image region of the stencil master in the direction of feed of the printing paper is adjusted (this adjustment will be referred to as "longitudinal registration", hereinbelow) by changing the timing at which the conveyor roller pair start conveying the printing paper by changing the rotation phase of the cam, which governs starting the guide roller of the conveyor roller pair, relative to the rotation phase of the printing drum.

However in the conventional paper feed mechanism, fluctuation in rotating speed of the main motor itself and fluctuation in rotating speed of the printing drum due to external factors such as impact when the press roller is brought into contact with the printing drum can occur. Further, phase shift between the printing drum and the conveyor roller pair can be generated due to backlash in the transmission mechanism including gears, an endless belt and the like which transmits torque of the main motor to the printing drum and the conveyor roller pair. Further since the printing drum and the conveyor roller pair are driven by the same main motor, it is almost impossible to control rotation of the conveyor roller pair to compensate for fluctuation in the rotating speed of the printing drum. Accordingly it is difficult to exactly register the leading end of the printing paper to a predetermined position on the stencil master on the printing drum and it is also difficult to adjust the mechanism for such registration. Further there has been fear that the mechanism for the longitudinal registration increases the phase shift between the printing drum and the conveyor roller pair due to said backlash. Thus there has been a problem that the printing paper is shifted from the desired position relative to the stencil master. This problem will be referred to as "position shift of the printing paper", hereinbelow.

Such a position shift of the printing paper can be generated also due to slip of the printing paper on the circumferential surfaces of the conveyor roller pair. That is, the printing paper can slip on the circumferential surfaces of the rollers due to paper dust thereon and/or wear of the rollers, which results in an amount of feed of the printing paper smaller than that expected. The difference between the actual amount of feed of the printing paper and the expected amount of feed of the printing paper cannot be compensated for and results in the position shift of the printing paper.

Further conventionally the stencil master is positioned relative to the clamp mechanism on the printing drum by pulse control of the stepping motor which drives the conveyor roller for conveying the stencil master. However when the leading end portion of the stencil master is curved or the stencil master slips on the conveyor roller, it is difficult to accurately position the stencil master in a desired position relative to the clamp mechanism, which also results in the position shift of the printing paper.

Further since the clamp mechanism generally holds the leading end portion of the stencil master, the stencil master can shift relative to the printing drum in the direction opposite to the direction of rotation of the printing drum due to repetition of actions of bringing the press roller into contact with and away from the printing drum and/or tensile force momentarily generated when the trailing end portion of the printing paper is caught by the pickup roller and the scraper. Such shift of the stencil master also results in the position shift of the printing paper even if the actual amount of feed of the printing paper is equal to the expected amount of feed of the printing paper.

SUMMARY OF THE INVENTION

In view of the foregoing observations and description, the primary object of the present invention is to provide a stencil printer which is free from shift of printing position on the printing paper due to fluctuation in the rotating speeds of the printing drum and the conveyor roller pair, slip of the printing paper in the paper feed mechanism or shift of the stencil master on the print drum.

A stencil printer in accordance with a first aspect of the present invention comprises

- a rotary printing drum which is provided with a master clamp mechanism for holding an end of a stencil master and around which the stencil master is wrapped,
- a printing drum drive means which rotates the printing drum,
- a press roller which is rotatable in parallel to the printing drum in contact with the printing drum, and
- a pair of opposed conveyor rollers which feed a printing paper between the printing drum and the press roller so that the leading end of the printing paper meets the printing drum in a predetermined position of the printing drum, and is characterized by having
  - a conveyor roller drive means which is provided separately from the printing drum drive means and drives the conveyor rollers,
  - a reference position detecting means which detects a reference position on the printing drum,
  - a printing drum rotation detecting means which detects rotation of the printing drum on the basis of the reference position detected by the reference position detecting means,
  - a conveyor roller rotation detecting means which detects rotation of at least one of the conveyor rollers, and
  - a conveyor roller control means which controls the conveyor roller drive means on the basis of the rotation of the printing drum detected by the printing drum rotation detecting means and the rotation of the conveyor roller detected by the conveyor roller rotation detecting means so that the leading end of the printing paper meets the printing drum in the predetermined position of the printing drum.

In the stencil printer of the first aspect, since the conveyor roller control means controls the conveyor roller drive means on the basis of the actual rotation of the printing drum detected by the printing drum rotation detecting means and the actual rotation of the conveyor roller detected by the conveyor roller rotation detecting means, shift of printing position on the printing paper due to fluctuation in the rotating speeds of the printing drum and the conveyor rollers can be prevented.

It is preferred that the reference position detecting means detects a predetermined position on the stencil master on the printing drum such as the leading end of the stencil master or a mark recorded on the stencil master.

With this arrangement, shift of printing position on the printing paper due to shift of the stencil master on the print drum can be prevented.

Further it is preferred that the printing drum rotation detecting means detects the rotating speed and the angular position of the printing drum, the conveyor roller rotation detecting means detects the rotating speed and the angular position of the conveyor roller, and the conveyor roller control means controls the conveyor roller drive means on the basis of the rotating speed and the angular position of the printing drum and the rotating speed and the angular position of the conveyor roller so that the leading end of the printing paper meets the printing drum in the predetermined position of the printing drum.

A stencil printer in accordance with a second aspect of the present invention comprises

- a rotary printing drum which is provided with a master clamp mechanism for holding an end of a stencil master and around which the stencil master is wrapped,
- a printing drum drive means which rotates the printing drum,
- a press roller which is rotatable in parallel to the printing drum in contact with the printing drum, and
- a pair of opposed conveyor rollers which feed a printing paper between the printing drum and the press roller so that the leading end of the printing paper meets the printing drum in a predetermined position of the printing drum, and is characterized by having
  - a conveyor roller drive means which is provided separately from the printing drum drive means and drives the conveyor rollers,
  - a reference position detecting means which detects a reference position on the printing drum,
  - a printing drum rotation detecting means which detects the rotating speed and the angular position of the printing drum on the basis of the reference position detected by the reference position detecting means,
  - a conveyor roller rotation detecting means which detects the rotating speed and the angular position of at least one of the conveyor roller pair,
  - a paper end detecting means which detects the leading end of the printing paper conveyed by the conveyor rollers at a predetermined distance from the rollers between the conveyor rollers and the press roller, and
  - a conveyor roller control means which controls the conveyor roller drive means on the basis of the rotating speed and the angular position of the printing drum and the rotating speed and the angular position of the conveyor roller so that the leading end of the printing paper meets the printing drum in the predetermined position of the printing drum.

The conveyor roller control means starts the conveyor roller drive means at a first time point at which the printing drum is in a first angular position, accelerates the conveyor roller drive means up to a second time point at which the printing drum is in a second angular position at a distance from the first angular position corresponding to said predetermined distance from the rollers at which the paper end detecting means detects the leading end of the printing paper, keeps the conveyor roller drive means at the speed at the second time point, starts to re-accelerate the conveyor roller drive means at a re-accelerating time point which is determined according to a time point at which the leading end of the printing paper is detected by the paper end detecting means, and accelerates the conveyor roller drive means to a speed equal to the rotating speed of the printing drum.

The rate of acceleration of the conveyor roller drive means is determined on the basis of the rotating speed and the angular position of the printing drum at the first time point, and the re-accelerating time point is determined according to the space between the second time point and the time point at which the leading end of the printing paper is detected by the paper end detecting means so that the re-accelerating time point is advanced from a reference re-accelerating time point by an amount which compensates for the delay in conveyance of the printing paper represented by the space between the second time point and the time point at which the leading end of the printing paper is detected. The reference re-accelerating time point has been set so that the leading end of the printing paper can meet the printing drum in the predetermined position when re-acceleration of the conveyor roller drive means is started at the reference re-accelerating time point so long as the leading end of the printing paper is detected at the second time point.

With this arrangement, shift of printing position on the printing paper due to slip between the printing paper and the conveyor rollers can be prevented.

It is preferred that the conveyor roller control means controls the conveyor roller drive means according to the following formula $$X=(\eta-1)s$$

wherein s represents said delay in conveyance of the printing paper, X represents the amount by which the re-accelerating time point is advanced from the reference re-accelerating time point, η represents the ratio of the space between the second time point and a limit detecting time point by which the leading end of the printing paper must be detected in order to compensate for the delay in conveyance of the printing paper to the space between the second time point and the re-accelerating time point for the limit detecting time point.

A stencil printer in accordance with a third aspect of the present invention comprises a rotary printing drum which is provided with a master clamp mechanism for holding an end of a stencil master and around which the stencil master is wrapped, a press roller which is rotatable in parallel to the printing drum in contact with the printing drum, a pair of opposed conveyor rollers which feed a printing paper between the printing drum and the press roller, a conveyor roller drive means which starts to rotate the conveyor rollers upon receipt of a start signal which is generated with the leading end of a printing paper conveyed from a paper supply section in abutment against one of the conveyer rollers near the contact line of the rollers, a printing drum rotation detecting means which detects the angular position of the printing drum, a reference position detecting means which detects a reference position on the stencil master on the printing drum, and a conveyor roller control means which generates the start signal when the printing drum is rotated by a predetermined angle from the time at which the reference position is detected by the reference position detecting means.

In the stencil printer in accordance with the third aspect of the present invention, since the timing at which the conveyor rollers are started is determined on the basis of the angular position of the stencil printer itself, the timing is shifted with shift of the stencil master and accordingly the longitudinal registration can be kept unchanged even if the stencil master is shifted from the original position during printing and at the same time the accuracy in positioning the stencil master on the printing drum does not affect the longitudinal registration.

It is preferred that the conveyor roller control means be arranged so that said predetermined angle can be changed through an external input means.

With this arrangement, the timing at which the conveyer rollers are started can be changed relative to the position of the stencil master, whereby the longitudinal registration can be effected simply with a simple mechanism.

DESCRIPTION OF THE PREFERRED EMBODIMENT

Figure 1:
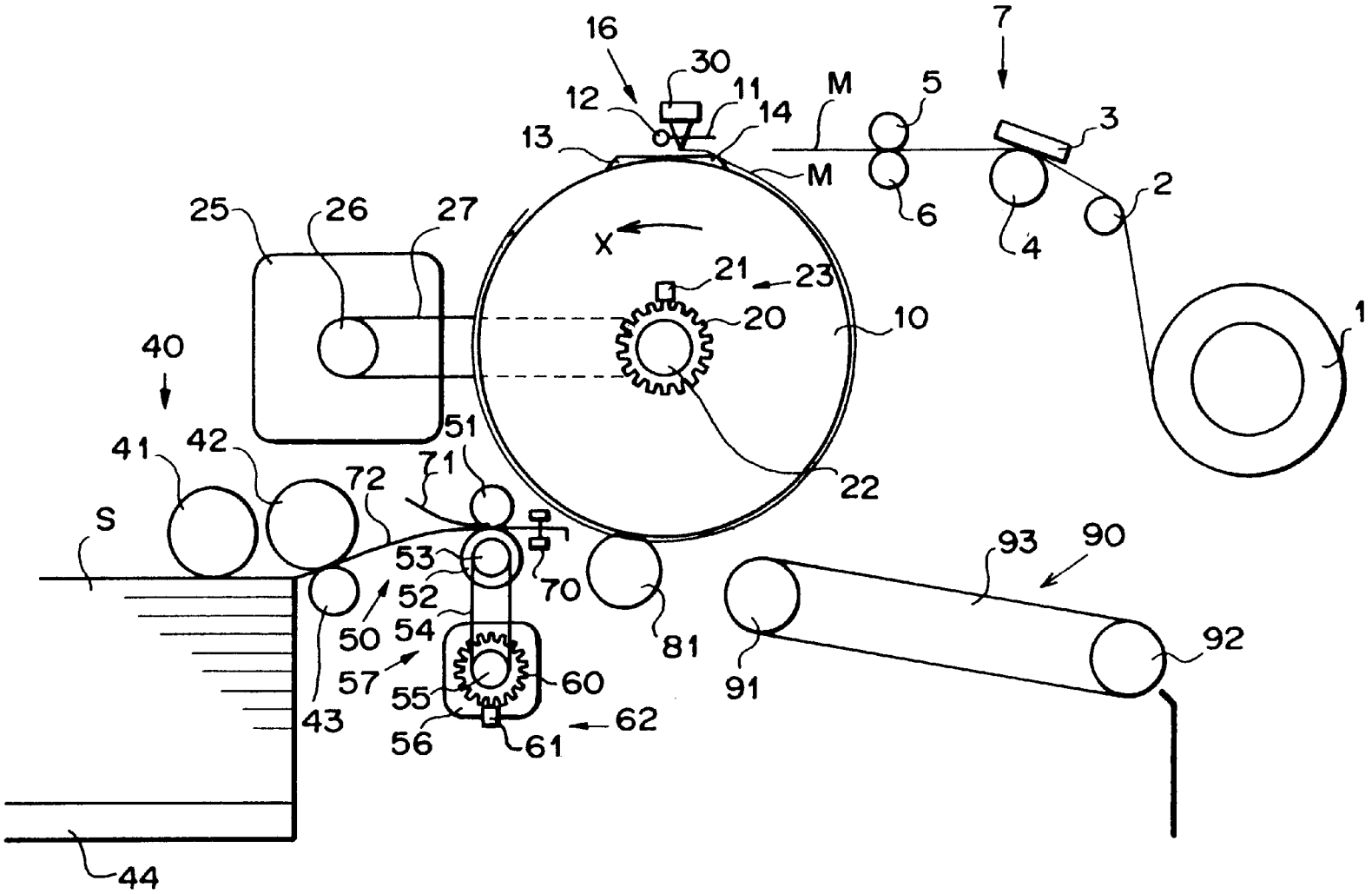
FIG. 1 is a schematic side view of a stencil printer in accordance with an embodiment of the present invention.

In FIG. 1, a stencil printer in accordance with an embodiment of the present invention comprises a cylindrical printing drum 10, a press roller 81 which is pressed against the printing drum 10 and is rotatable in parallel to the printing drum 10, a primary paper feed section 40 which comprises a scraper roller 41, a pickup roller 42 and a separator roller 43 and feeds one printing paper from a stack S of printing papers on a paper feed table 44 each time the printing drum 10 makes one rotation, and a secondary paper feed section 50 which comprises a pair of register rollers 51 and 52 (conveyor roller pair), guide plates 71 and 72, and the like and inserts the printing paper, fed by the primary paper feed section 40, between the printing drum 10 and the press roller 81.

The printing drum 10 is rotated by a main motor 25 by way of a drive gear 26 formed on the output shaft of the main motor 25, a gear (not shown) formed on a rotary shaft 22 of the printing drum 10 and an endless belt 27 in mesh with the gears. A drum encoder 20 in the form of teeth formed on the circumferential surface of the rotary shaft 22 of the printing drum 10 at regular intervals and a photosensor 21 which outputs a drum pulse each time it detects one of the teeth form a printing drum rotation detecting means 23. A clamp mechanism 16 for holding the leading end of the stencil master M is provided on the printing drum 10 to extend along a generatrix of the circumferential surface thereof. A reference position detecting means (master sensor) 30 which detects a reference position on the printing drum 10 (in this particular embodiment, the leading end of the stencil master M) from which the angular position of the printing drum 10 is measured is disposed near the clamp mechanism 16 separately from the printing drum 10.

A master making section 7 which comprises a guide roll 2, a thermal head 3, a platen roller 4 and a pair of conveyor rollers 5 and 6 and makes a stencil master M by image-wise heating a master material fed from a master roll 1 is disposed near the printing drum 10.

Figure 2:
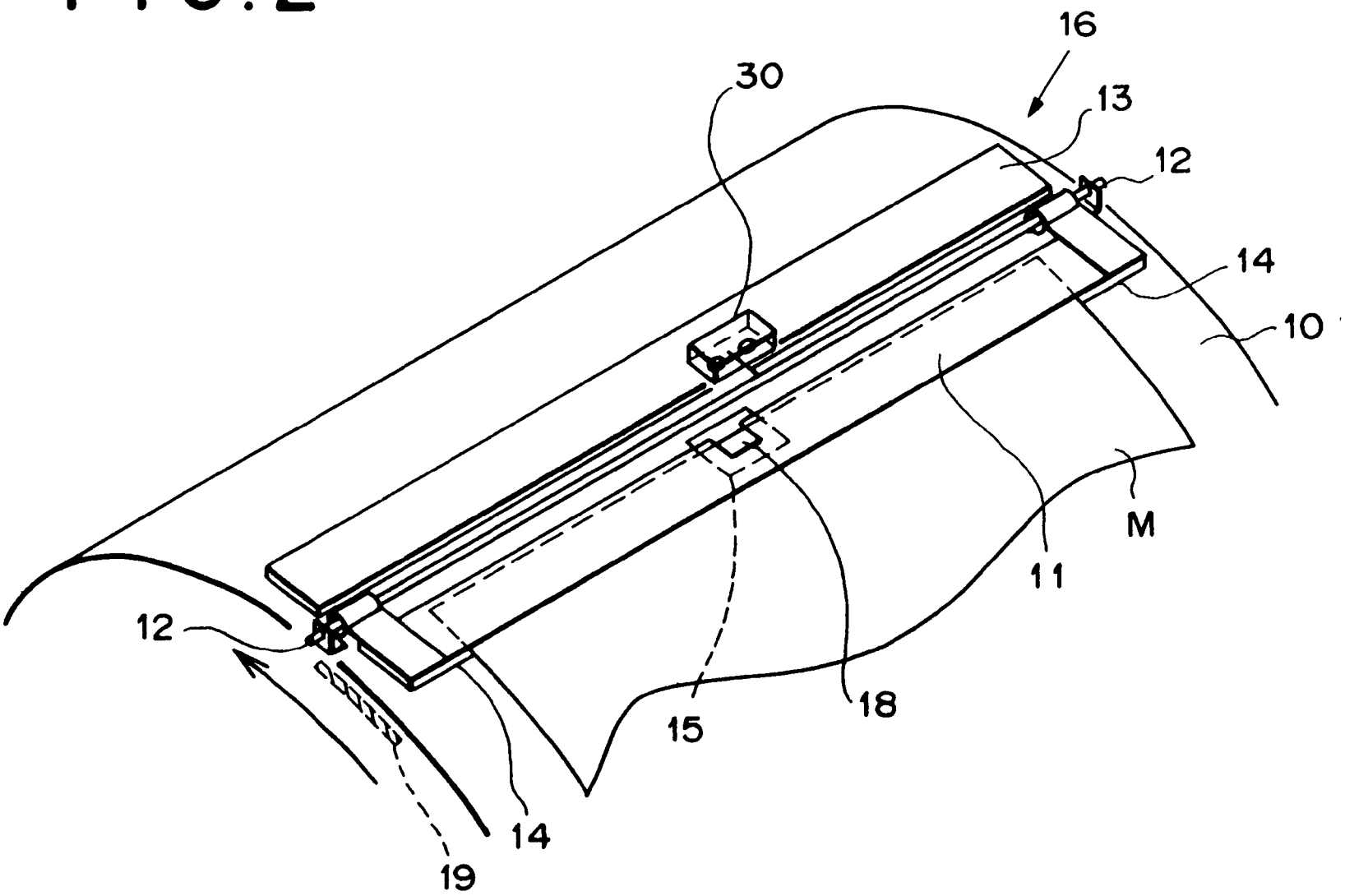
FIG. 2 is an enlarged perspective view showing in detail the clamp mechanism and the master sensor.

As shown in detail in FIG. 2, the clamp mechanism 16 comprises a magnetic clamp plate 11 fixed to a rotary pin 12 which extends along a generatrix of the printing drum 10 and is supported for rotation at opposite ends thereof, and a pair of retainer plates 14 and 13 which hold the clamp plate 11 under the magnetic force of the clamp plate 11 respectively in a clamping position or a closing position where the clamp plate 11 pinches the leading end of the stencil master M together with the retainer plate 14 and an opening position where the clamp plate 11 releases the stencil master M. A monitor window 18 is formed in the clamp plate 11 at a middle portion thereof. An anti-reflective region 15 is formed around the monitor window 18. The master sensor 30 comprises an LED and a photosensor and the photosensor receives light emitted from the LED and reflected at the surface of the leading end portion of the stencil master M, thereby detecting the leading end of the stencil master M. The anti-reflective region 15 prevents irregular reflection of the light emitted from the LED. Preferably a reflecting film 19 is provided on a side surface of the printing drum 10 to extend arcuately over an angular range including the angular range where the monitor window 18 extends as shown by the dotted line in FIG. 2 and another sensor, which may be similar to the master sensor 30, is provided to actuate the master sensor 30 only when it is detecting the reflecting film 19. With this arrangement, since the master sensor 30 is actuated only near the monitor window 18, possibility of malfunction of the master sensor 30 can be suppressed.

The register rollers 51 and 52 are interlocked with each other to rotate together in opposite directions by way of gears which are formed on opposite ends of the respective rollers and are in mesh with each other at each end. The register roller 52 is driven by a register roller drive means 57 comprising a register motor 56, a gear 53 formed on the rotating shaft of the register roller 52, a gear (not shown) formed on the output shaft 55 of the register motor 56 and an endless belt 54 in mesh with the gear 53 on the register roller 52 and the gear on the output shaft 55. A register encoder 60 in the form of teeth formed on the circumferential surface of the output shaft 55 of the register motor 56 at regular intervals and a photosensor 61 which outputs a register pulse each time it detects one of the teeth form a register roller rotation detecting means 62 which detects information on rotation of the register roller 52 by way of information on rotation of the register motor 56. Preferably the register motor 56 is a DC servomotor.

Figure 3:
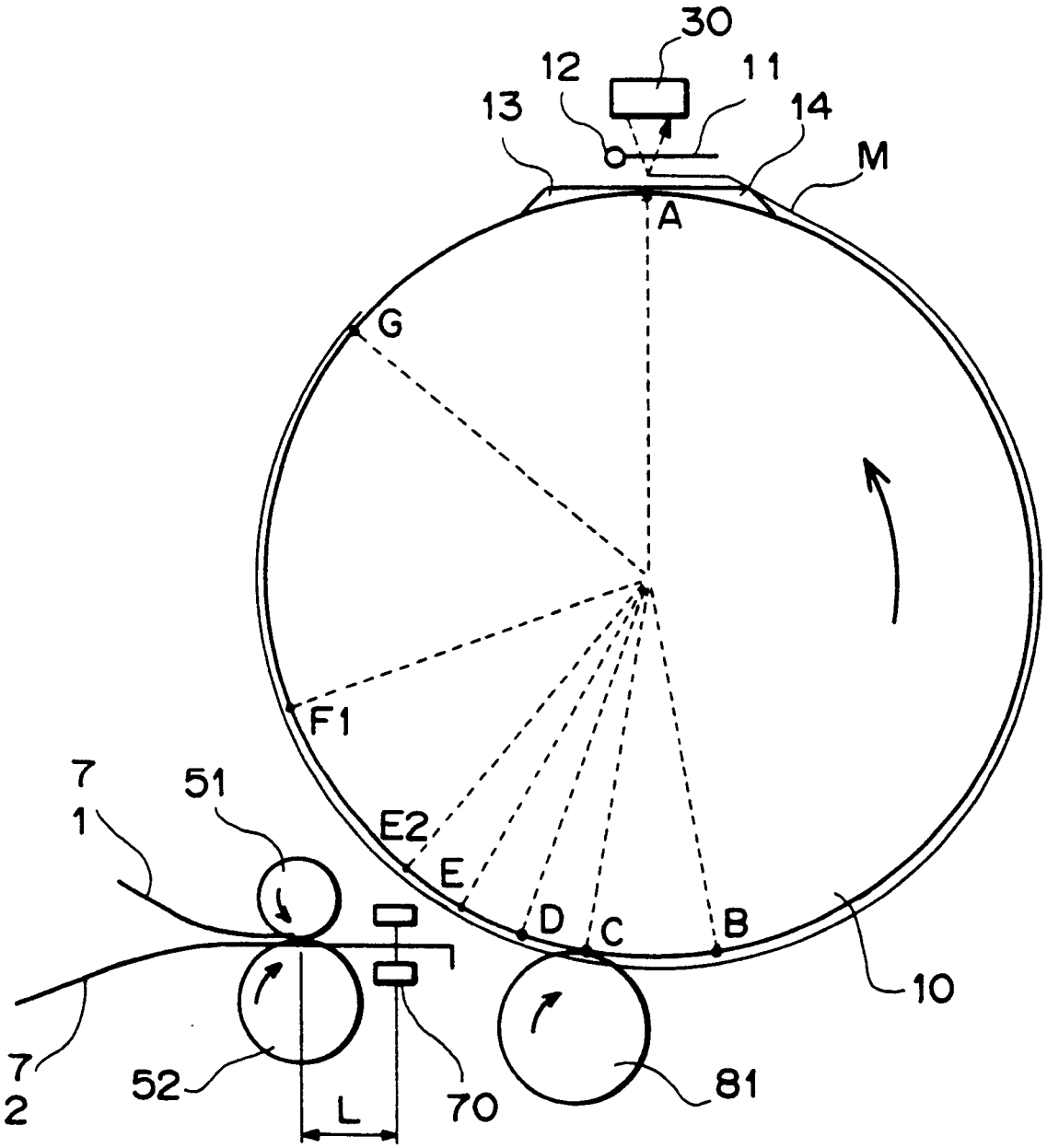
FIG. 3 is a fragmentary side view showing an important part of the stencil printer.

Between the register rollers 51 and 52 and the press roller 81, there is disposed a register sensor (paper end detecting means) 70 which detects the leading end (as seen in the direction of conveyance of the printing paper) of the printing paper at a predetermined distance L from the register rollers 51 and 52 downstream thereof as shown in FIG. 3.

The stencil printer of this embodiment is provided with a control means 170 (FIG. 4) which controls a motor drive circuit 160 (FIG. 4) for driving the register motor 56 on the basis of drum rotation information detected by the printing drum rotation detecting means 23 and register roller rotation information detected by the register roller rotation detecting means 62.

On the downstream side of the press roller 81 as seen in the direction of conveyance of the printing paper, there is disposed a paper discharge section 90 which stacks printed papers removed from the printing drum 10. The paper discharge section 90 comprises a pair of suction rollers 91 and 92 and a suction belt 93 passed around the suction rollers 91 and 92.

Figure 4:
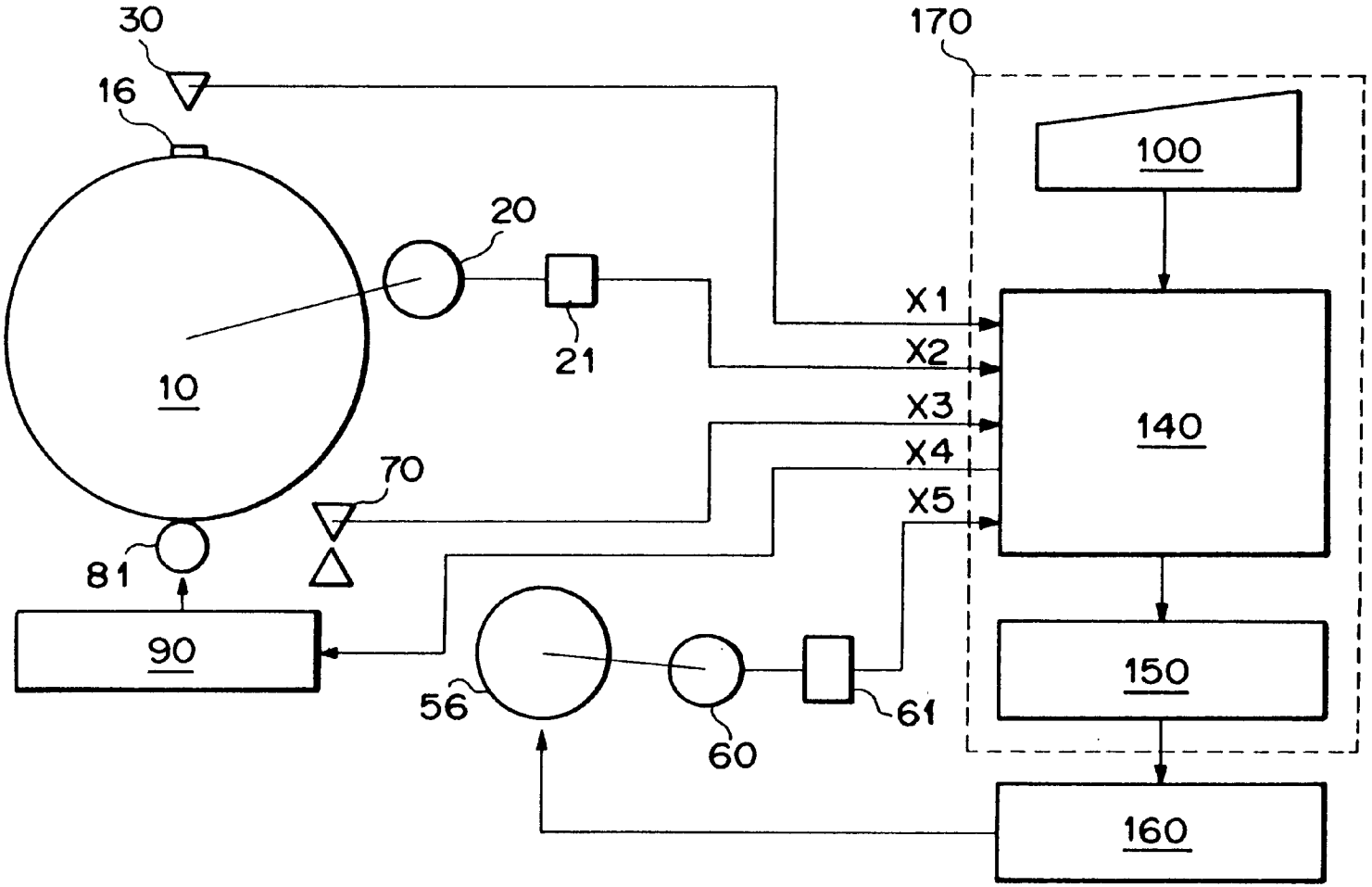
FIG. 4 is a block diagram showing the control means of the stencil printer.

FIG. 4 schematically shows the arrangement of the stencil printer of this embodiment. The control means 170 may comprise, for instance, a CPU which executes various processings described later. Drum pulses X2 output from the photosensor 21 of the printing drum rotation detecting means 23 and a reference pulse X1 output from the master sensor 30 upon detection of the leading end of the stencil master M are input into a motor control circuit 140. The reference pulse X1 is detected each time the printing drum 10 makes one rotation and the number of the drum pulses X2 is counted from the time the reference pulse X1 is detected. That is, the number of the drum pulses X2 represents the angular position or the rotation-phase position of the printing drum 10. Register pulses X5 output from the photosensor 61 of the register roller rotation detecting means 62 representing the rotation of the register motor 56, that is, the register rollers 51 and 52 are also input into the motor control circuit 140.

In the motor control circuit 140, the value NB of count of the drum pulses X2 at which the register motor 56 is to be started (this value NB will be referred to as "the register motor starting count NB", hereinbelow) is set in advance and the number of the drum pulses X2 reaches the register motor starting count NB, a PWM (pulse width modulator) signal generator 150 is started. The register motor starting count NB can be changed through a control panel 100. The PWM signal generator 150 starts the register motor 56 by way of the motor drive circuit 160, thereby driving the register rollers 51 and 52 to convey the printing paper. Thus the timing at which the leading end of the printing paper is to be inserted between the printing drum 10 and the press roller 81 can be controlled by changing the register motor starting count NB. In other words, the position of the printing paper relative to the stencil master M in which the printing paper is brought into contact with the stencil master M can be controlled by changing the register motor starting count NB. That is, the "longitudinal registration" can be carried out by changing the register motor starting count NB. Further since the number of the drum pulses X2 is counted from the position of the leading end of the stencil master M, the position of the printing paper relative to the stencil master M can be kept unchanged even if the leading end of the stencil master M is shifted relative to the printing drum 10 in the direction opposite to the direction of rotation of the printing drum 10. Further the motor control circuit 140 watches the register pulses X5 and controls the motor drive circuit 160 so that the rotating speed of the register motor 56 is kept in a predetermined relation (to be described later) with the rotating speed of the printing drum 10.

A paper end pulse X3 which is output from the register sensor 70 upon detection of the leading end of the printing paper is also input into the motor control circuit 140. When the paper end pulse X3 is not detected by a predetermined time, which occurs when slip of the printing paper occurs during conveyance, the motor control circuit 140 controls the register motor 56 by way of the motor drive circuit 160 so that the delay in conveyance of the printing paper due to slip is compensated for and the printing paper meets the stencil master M in the preset position relative to the stencil master M. Thus shift of the printing paper relative to the stencil master M due to slip of the printing paper during conveyance, which cannot be dealt with by simply controlling the rotating speed of the register roller 51 and 52 relative to the rotating speed of the printing drum 10, can be prevented as will be described in more detail later. Such a control of the register motor 56 will be referred to as "the slip compensation control", hereinbelow.

The operation of the stencil printer of this embodiment will be described with reference to FIGS. 5 to 11, hereinbelow.

First the master making process will be described. In the master making section 7 (FIG. 1), the master material is fed out from the master roll 1 and conveyed between the thermal head 3 and the platen roller 4 guided by the guide roller 2. While the master material travels between the thermal head 3 and the platen roller 4, the thermal head 3 image-wise heats the master material according to an image signal input from an image read-out section (not shown), thereby making a stencil master M. At this time, the conveyor rollers 5 and 6 are kept stopped and the stencil master M is temporarily stored in a storage box (not shown) disposed between the conveyor rollers 5 and 6 and the thermal head 3.

Then the printing drum 10 is rotated to the master mounting position shown in FIG. 1 and the clamp plate 11 is moved to the opening position where it is on the retainer plate 13. In this state, the conveyor rollers 5 and 6 are started to convey the stencil master M. The conveyor rollers 5 and 6 are driven by a stepping motor (not shown) and the stepping motor is driven by a predetermined number of pulses so that the leading end of the stencil master M is stopped in a predetermined position. After the leading end of the stencil master M is stopped in the predetermined position, the clamp plate 11 is rotated to the clamping position where it abuts against the retainer plate 14 with the leading end portion of the stencil master M pinched therebetween. Then the main motor 25 is energized to rotate the printing drum 10 in the direction of arrow X at a low speed and when the printing drum 10 is rotated by a predetermined angle, the stencil master M is severed from the master material in a continuous length, whereby the stencil master M is wrapped around the printing drum 10. The master sensor 30 detects the leading end of the stencil master M through the monitor window 18 in the clamp plate 11. Though, in this embodiment, the master sensor 30 detects the leading end of the stencil master M, the master sensor 30 may detect, for instance, a mark on the stencil master M recorded by the thermal head 3 during the master making process.

Figure 6:
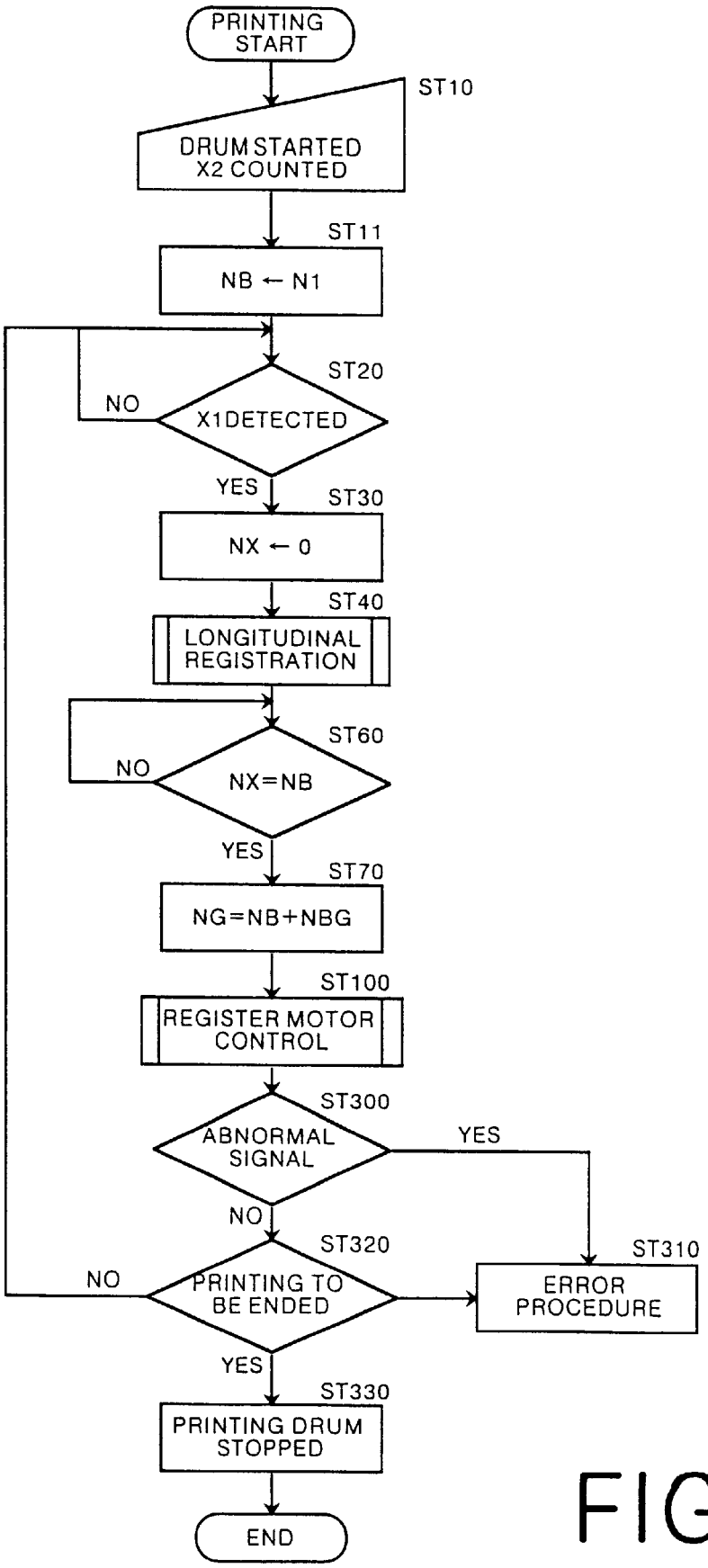
FIG. 6 is a flow chart for illustrating the main processing to be executed by the control means.

The printing operation of the stencil printer of this embodiment will be described with reference to the flow chart shown in FIG. 6, hereinbelow.

The main motor 25 is started to rotate the printing drum 10 and count of the drum pulses X2 is started (step ST10), and then the register motor starting count NB is set to a standard value N1 (step ST11). When a reference pulse X1 from the master sensor 30 is detected, that is, when the leading end of the stencil master M is in position A (FIG. 3) just below the master sensor 30, the count NX of the drum pulses X2 is once cleared. (steps ST20 and ST30) Then count of the drum pulses X2 is resumed. That is, the position of the leading end of the stencil master M is set as a reference position on the basis of which the angular position and the rotating speed of the printing drum 10 are measured. The angular position of the printing drum 10 can be known as the number of the drum pulses X2 detected after detection of reference pulse X1 output from the master sensor 30 and the rotating speed of the printing drum 10 can be known from the period of one drum pulse X2. By detecting the angular position of the printing drum 10 in this manner, the position of the printing paper relative to the stencil master M, i.e., "longitudinal registeration", can be kept as set initially even if the stencil master M is shifted from the original position during printing.

The register motor starting count NB which governs the longitudinal registeration can be changed by inputting an adjustment value through the control panel 100 as described above. Step ST 40 (the longitudinal registeration sub-routine shown in FIG. 7) is executed only when an adjustment value is input through the control panel 100 and is normally passed.

In response to start of the main motor 25 (step ST 10), the primary paper feed section 40 is driven by the main motor 25 by way of a transmission mechanism which is not shown and may be of the conventional structure and the uppermost printing paper in the stack S of the printing papers is separated from the stack S and is brought into abutment against the contact line of the register rollers 51 and 52 which are kept stopped at this time, whereby the printing paper sags along the guide plate 71.

When the count NX of the drum pulses X2, that is, the number of the drum pulses X2 counted from the time the reference pulse X1 is detected, reaches the register motor starting count NB (step ST60), the register motor 56 is started to rotate the register rollers 51 and 52. In FIG. 3, when the printing drum 10 is rotated by an angle corresponding to arc AB after detection of the reference pulse X1 (when the point on the printing drum 10 which is in position B when the leading end of the stencil master M is in the position A reaches the position A: this time point will be referred to as "time point B", hereinbelow), the register motor 56 is started to rotate the register rollers 51 and 52. That is, the register motor starting count NB corresponds to rotation of the printing drum 10 which carries the leading end of the stencil master M to a position distant from the position A in the counterclockwise direction by an angle equal to the angle corresponding to arc AB. When the printing drum 10 is rotated by the angle corresponding to arc BG after time point B, the register motor 56 is stopped. The number of the drum pulses X2 corresponding to rotation of the printing drum 10 by the angle corresponding arc BG will be referred to as "the operating count NBG", hereinbelow. The register motor starting count NB is variable as described above whereas the operating count NBG is generally fixed. In step ST70, the sum of the register motor starting count NB and the operating count NBG is set as a register motor stopping count NG at which the register motor 56 is to be stopped. Then the register motor 56 is controlled so that rotation of the register rollers 51 and 52 are synchronized with rotation of the printing drum 10, that is, so that the register rollers 51 and 52 are in a predetermined relation with the printing drum 10 with respect to the rotating speed and the angular position. (step ST100: the register motor control sub-routine shown in FIGS. 8 and 9 to be described later) This processing is continued until the count NX of the drum pulses X2 reaches NF corresponding to rotation of the printing drum 10 by the angle corresponding to arc AF1 (FIG. 3), when the leading end of the printing paper reaches the contact line of the printing drum 10 and the press roller 81.

When the leading end of the printing paper reaches the contact line of the press roller 81 and the printing drum 10, the printing paper comes to be conveyed pinched by the press roller 81 and the printing drum 10. While the printing paper is conveyed by the press roller 81 and the printing drum 10, ink supplied from an ink supply section (not shown) is transferred to the printing paper through the stencil master M, whereby printing is effected. When the count NX of the drum pulses X2 reaches the register motor stopping count NG, the register motor 56 is stopped as will be described later with reference to FIG. 9.

When an abnormal signal is generated during the register motor control sub-routine as will be described later, a press roller solenoid 90 (FIG. 4) is actuated to move the press roller 81 away from the printing drum 10 and the register rollers 51 and 52 are kept rotated to discharge the printing paper (error procedure). (steps ST300 and ST310) Thereafter the printing drum 10 is stopped. (step ST330) This is because if the printing operation is continued despite that no printing paper reaches the press roller 81, the press roller 81 is stained with ink. It is preferred that an warning be provided as a display on the control panel 100 and/or sound.

The printed paper is peeled off the printing drum 10 by a scraper (not shown) disposed between the suction roller 91 and the printing drum 10 and conveyed by the suction belt 93 to be stacked in the paper discharge section 90.

These steps are repeated until a predetermined number of printing papers are printed (step ST320) and thereafter the printing drum 10 is stopped (step ST330).

Figure 7:
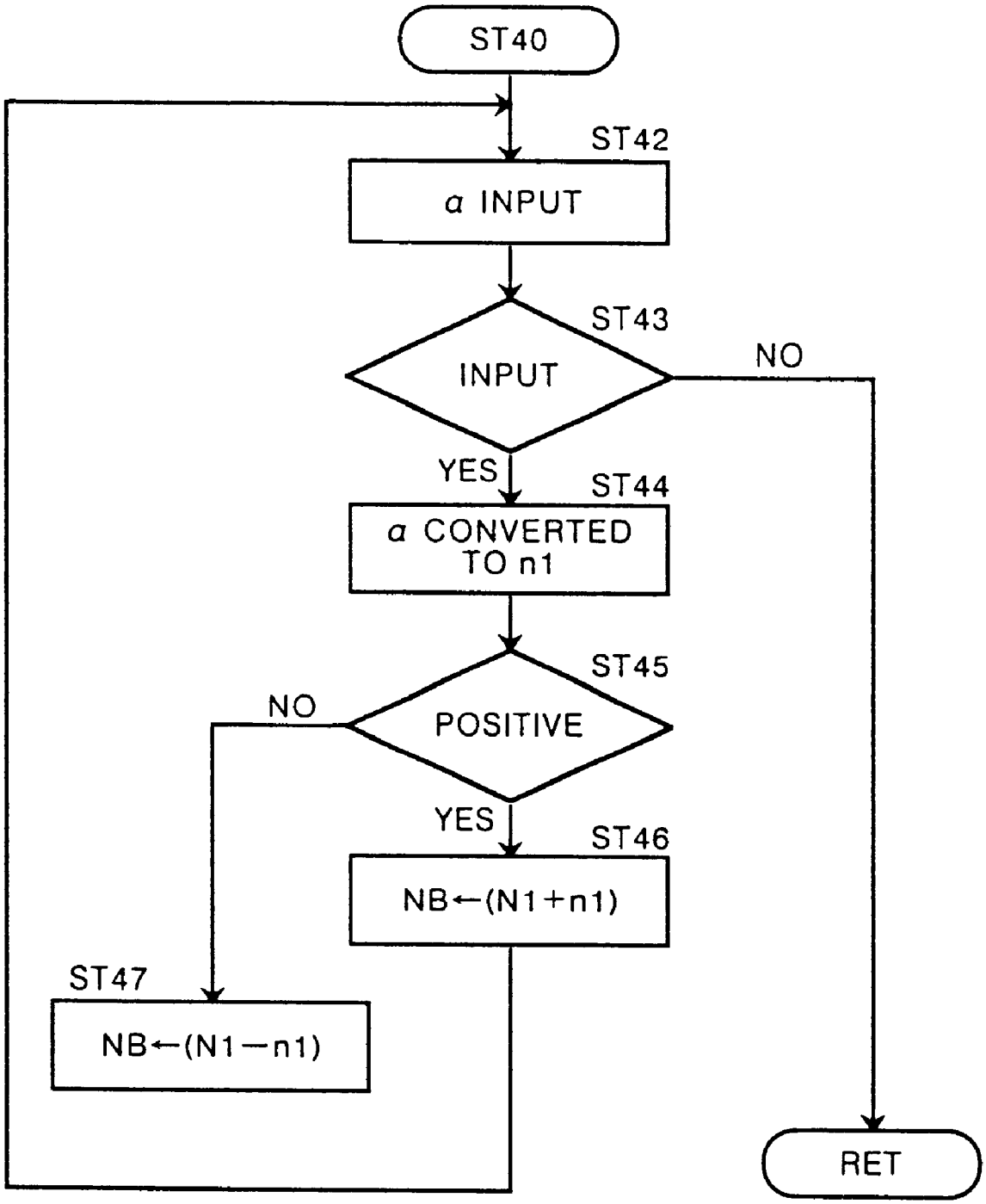
FIG. 7 is a flow chart for illustrating the longitudinal registration processing.

The longitudinal registration sub-routine shown in FIG. 7 will be described hereinbelow.

When the image to be printed on the printing paper is to be shifted upward (toward the leading end of the printing paper) from the standard position represented by the standard value N1, $+\alpha$ (adjustment value) is input though the control panel 100, and when the image to be printed on the printing paper is to be shifted downward (away from the leading end of the printing paper) from the standard position, $-\alpha$ (adjustment value) is input though the control panel 100, the value of $\alpha$ representing the distance by which the image is to be shifted upward or downward. (step ST42) When an adjustment value is input (step ST43: YES), the value of $\alpha$ is converted to a number n1 of drum pulses X2. (step ST44) When the adjustment value is positive (step ST45: YES), the register motor starting count NB is changed to N1+n1 (step ST46) and when the adjustment value is negative (step ST45: NO), the register motor starting count NB is changed to N1−n1 (step ST47). Thereafter step ST60 in FIG. 6 is executed. When no adjustment value is input in a predetermined time interval, or when, for instance, a return key is depressed, this sub-routine is passed. The value of the adjustment value is limited so that the image does not project outside the printing paper.

The register motor control sub-routine (step ST100) will be described in detail with reference to FIGS. 5 and 8 to 11, hereinbelow.

Figure 5:
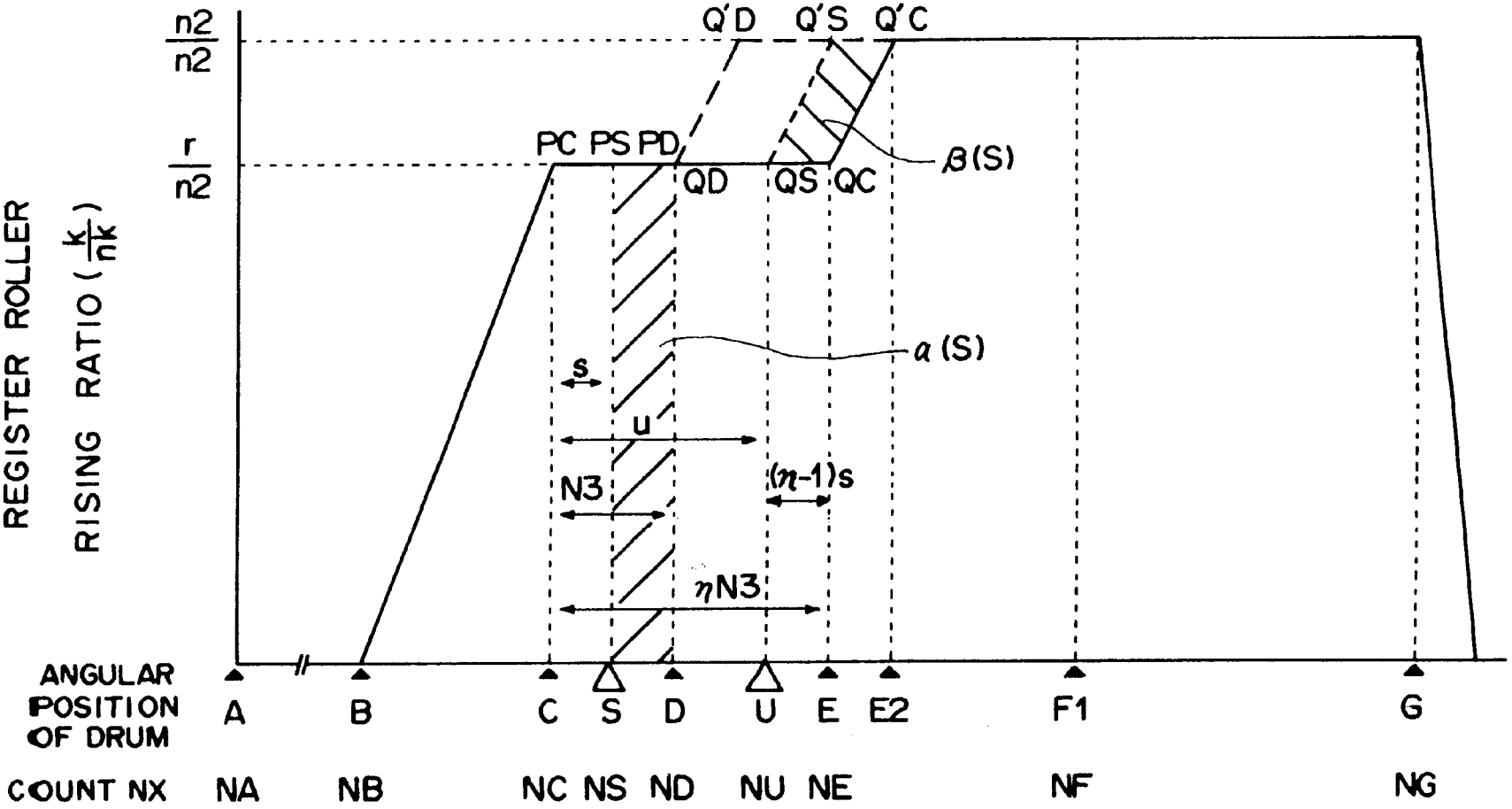
FIG. 5 is a chart for illustrating the operation of the stencil printer.

In this sub-routine, the register motor 56 is started when the count NX of the drum pulses X2 reaches the register motor starting count NB and is caused to rise to the rotating speed of the printing drum 10 in a plurality of steps (first to n2-th steps) as shown in FIG. 5. The register motor 56 is first caused to rise to r-th step at a time point the printing drum 10 is rotated by the angle corresponding to arc BC (FIG. 3) after the time point B, and the rotating speed of the register motor 56 is kept constant at the rotating speed in the r-th step. In FIG. 5, angular positions C, S, D, U, E, E2, F1 and G of the drum respectively correspond to angular positions of the printing drum 10 at time points the printing drum 10 is rotated by the angles C-B, S-B, D-B, U-B, E-B, E2-B, F1-B and G-B after the time point B, and the time points corresponding to angular positions C, S, D, U, E, E2, F1 and G of the drum will be sometimes referred to as "time point C", "time point S", "time point D", time point U""time point E", "time points E2", "time point F1" and "time point G", hereinbelow.

Then when the count NX reaches a predetermined value, the register motor 56 is re-accelerated to rise to the rotating speed of the printing drum 10 in (n2-r) steps. The predetermined value of the count NX is changed according to the time or the value of the count NX at which the paper end pulse X3 is detected to compensate for delay in conveyance of the printing paper due to slip (the aforesaid "slip compensation control"). For example, when the paper end pulse X3 is detected at time point C, the register motor 56 is re-accelerated at time point E and is caused to rise to the rotating speed of the printing drum 10 at time point E2. The time point C has been set so that when the printing paper is conveyed without slip, the leading end of the printing paper reaches the register sensor 70 at the time point C, and the time point E has been set so that the printing paper can meet the stencil master M in the preset position relative to the stencil master M when the register motor 56 is re-accelerated at the time point E so long as the leading end of the printing paper has reached the register sensor 70 at the time point C. Accordingly when the paper end pulse X3 is detected after the time point C, the register motor 56 is re-accelerated before the time point E in order to compensate for the delay as will be described in detail later.

The number of the steps in which the register motor 56 is caused to rise to the rotating speed of the printing drum 10 will be referred to as "the number of rising steps nk" and is set to n2 (e.g., 15). The number of the steps by which the register motor 56 has risen at a given time will be referred to as "the current number of rising steps k" and is incremented one by one in the range of 1 to n2. The step at which the rotating speed of the register motor 56 is kept constant for the purpose of the slip compensation control will be referred to as "the watching step Cr" and is represented in terms of the number of steps by which the register motor 56 has risen (the current number of rising steps k).

Figure 8:
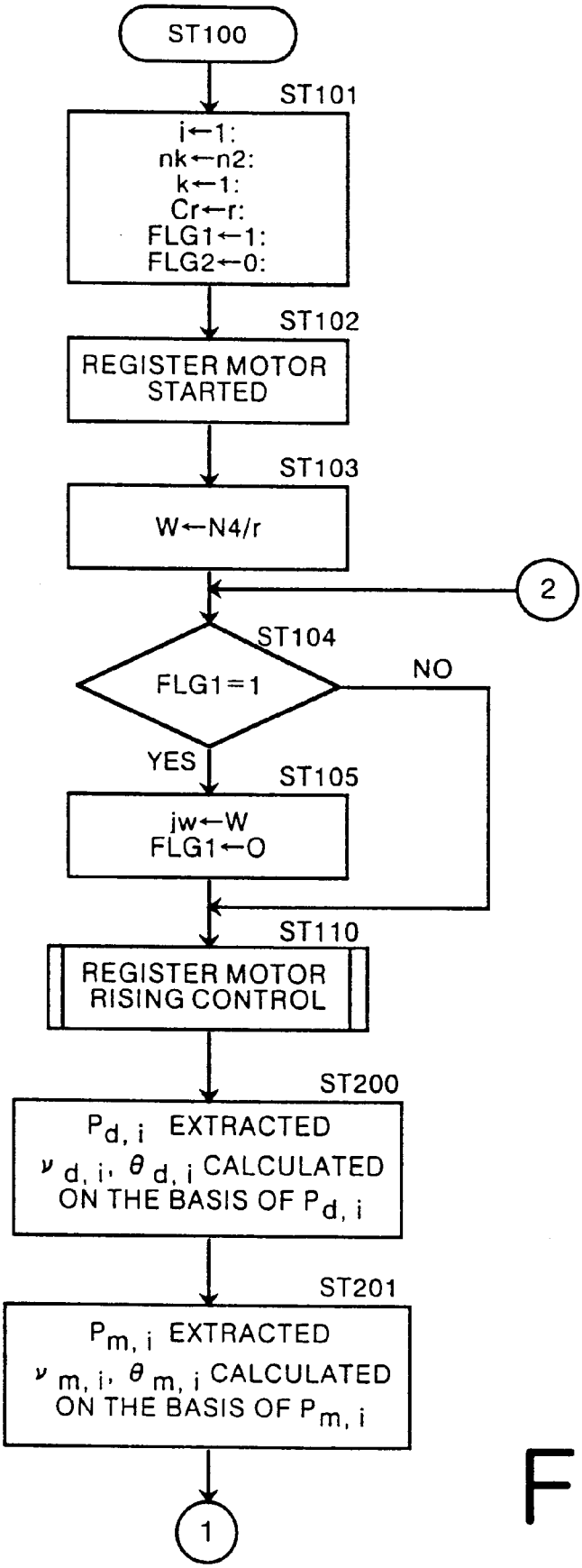
FIGS. 8 and 9 show a flow chart for illustrating the register motor control processing.
Figure 9:
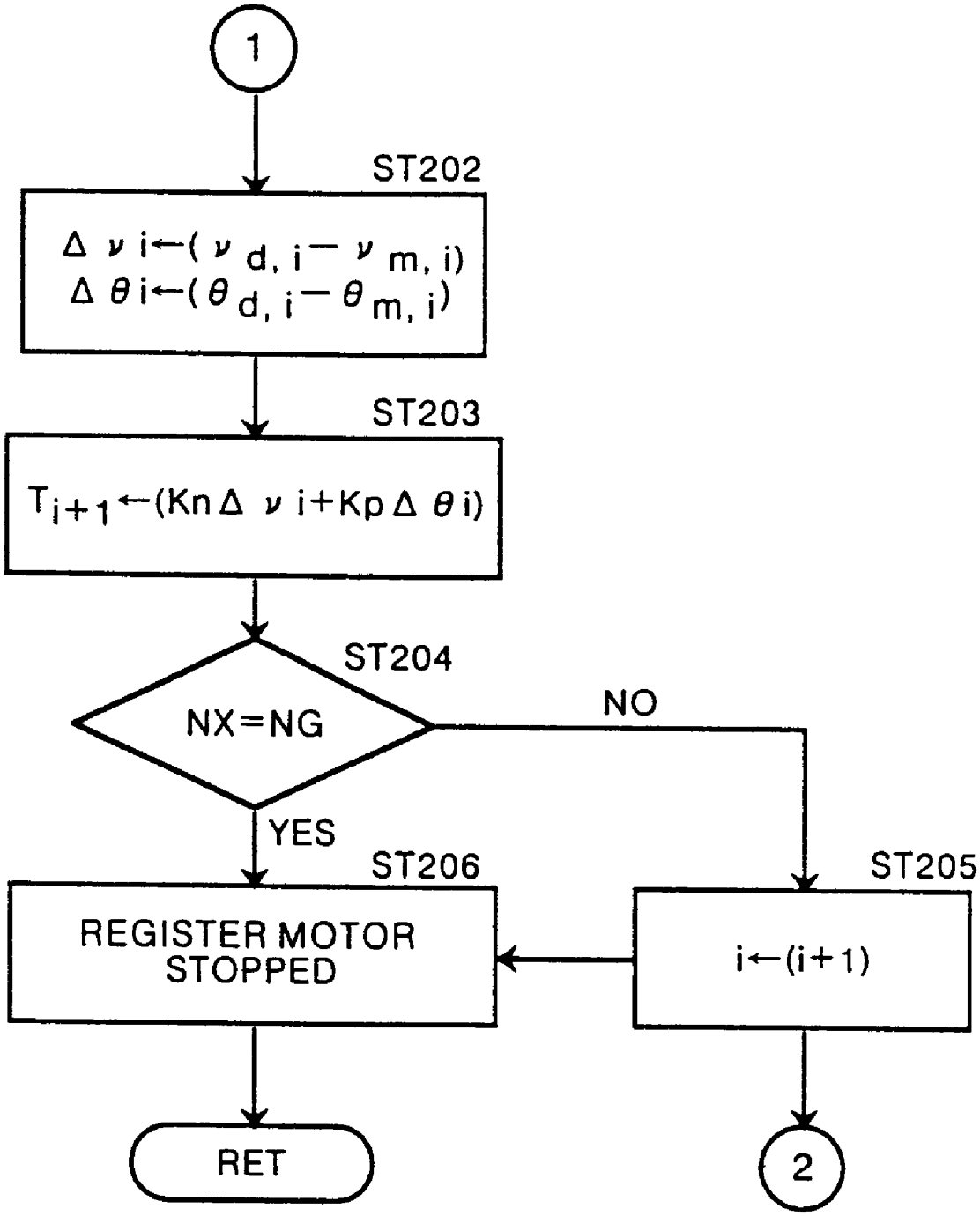

In the sub-routine shown in FIG. 8, step ST101 is an initialization step in which the number of drum pulses i counted from the time point B is set to 1, the number of the rising steps nk is set to n2, the current number of rising steps k is set to 1, the watching step Cr is set to r (e.g., 13), rising flag FLG1, which is for incrementing the current number of rising steps k one by one, is set to 1, and register flag FLG2 is set to 0. The register flag FLG2 represents that the leading end of the printing paper has not been detected by the register sensor 70, i.e, the paper end pulse has not been detected, when it is 0, and that the leading end of the printing paper has been detected by the register sensor 70, i.e, the paper end pulse has been detected, when it is 1.

The rising flag FLG1 is set to 1 when the count of a backward counter, which is decremented from rising width count jw (the number of the drum pulses X2 corresponding to the period in which the register motor 56 rises by one step) one by one each time one drum pulse X2 is detected, becomes 0, and when the rising flag FLG1 is set to 1, the current number of rising steps k is incremented by one and the rising flag FLG1 is set to 0 to reset the backward counter. Specifically the value W of the rising width count jw is obtained by dividing the value of the number of drum pulses i at the time point C (FIG. 5) (N4=NC−NB) by the value r of "the watching step Cr", that is, W=N4/r.

After the initialization step ST101, the register motor 56 is started (step ST102), and then the value W of the rising width count jw is set to N4/r (step ST103).

Then register motor rising control is executed (step ST110) immediately when the rising flag FLG1 is 0 (step ST104: NO) and after resetting the rising width count jw to W and resetting the rising flag FLG1 to 0 (step ST105) when the rising flag FLG1 is 1 (step ST104: YES).

Figure 10:
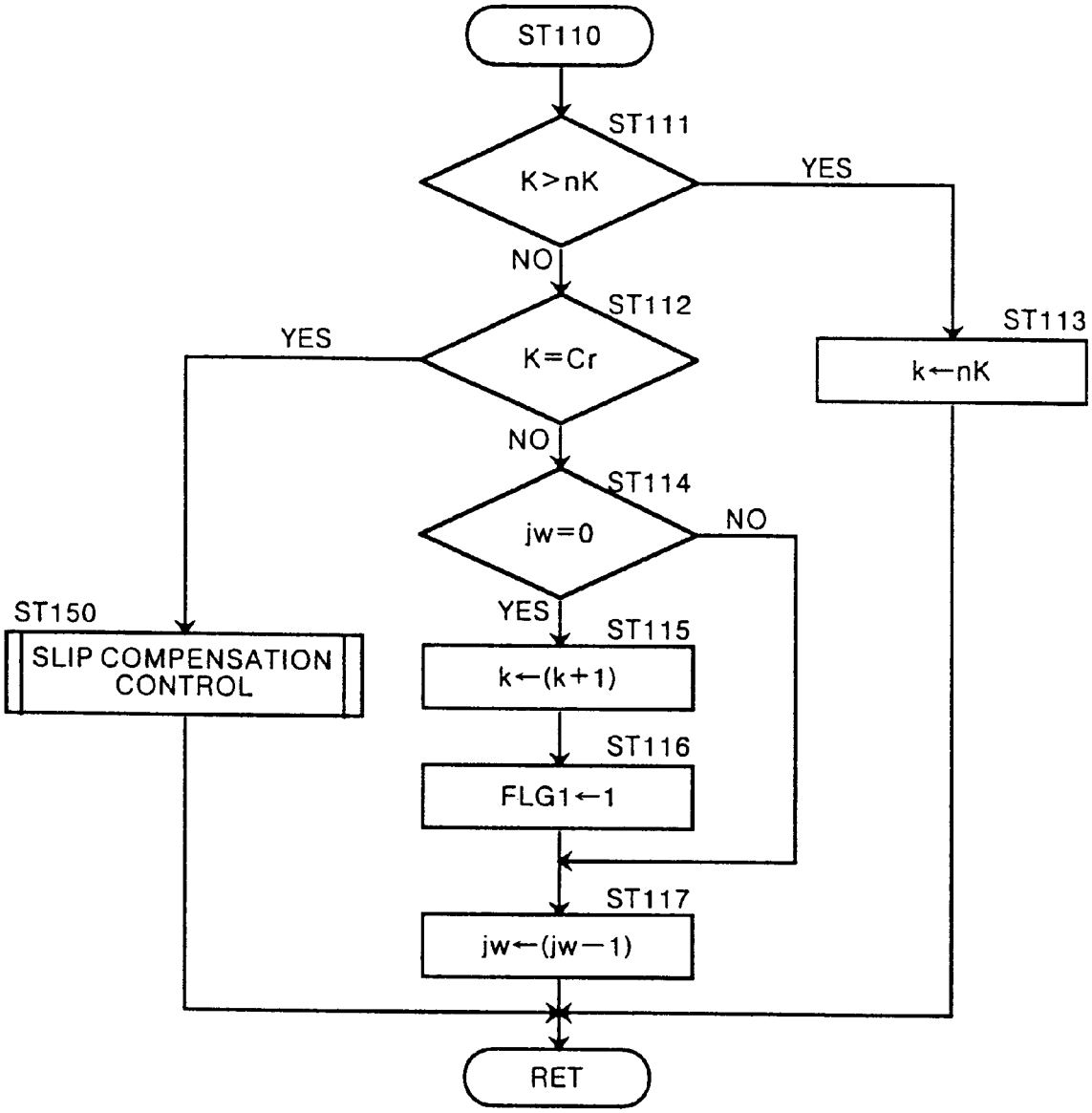
FIG. 10 is a flow chart for illustrating the register motor rising control processing.

As shown in FIG. 10, in the register motor rising control, the register motor 56 is caused to rise to the watching step Cr while the current number of rising steps k is incremented one by one. (steps ST111, ST112, ST114, ST115, ST116 and ST117) When the current number of rising steps k becomes equal to r (the watching step Cr) (step ST112: YES), the aforesaid slip compensation control is executed (step ST150). When the current number of rising steps k becomes larger than n2 (the number of rising steps nk), the current number of rising steps k is set to n2 in order to prevent further acceleration of the register motor 56 (step ST113).

When the current number of rising steps k becomes equal to r (the watching step Cr), steps ST114 to ST117 are not executed and accordingly the rotating speed of the register motor 56 is kept constant at the speed at the time the current number of rising steps k becomes equal to r. In this state the slip compensation control is executed.

In FIG. 5, as described above, when the paper end pulse X3 is detected at time point C, the register motor 56 is re-accelerated at time point E and is caused to rise to the rotating speed of the printing drum 10 at time point E2. The time point C has been set so that when the printing paper is conveyed without slip, the leading end of the printing paper reaches the register sensor 70 at the time point C, and the time point E has been set so that the printing paper can meet the stencil master M in the preset position relative to the stencil master M when re-acceleration of the register motor 56 is started at the time point E so long as the leading end of the printing paper has reached the register sensor 70 at the time point C. A point PC of the register motor rising line corresponding to the time point C will be referred to as "the reference detecting point" and a point QC corresponding to the time point E will be referred to as "the reference re-accelerating point". For example when the paper end pulse X3 is detected at a time point S, the register motor 56 is re-accelerated at a time point U in order to compensate for the number s of drum pulses by which detection of the paper end pulse X3 is delayed behind the reference detecting point PC (the amount of delay in conveyance of the printing paper). A point PS corresponding to the time point S will be referred to as "the actual detecting point" and a point QS corresponding to the time point U will be referred to as "the re-accelerating point". In this case, the re-accelerating point is advanced from the reference re-accelerating point QC by the number of the drum pulses ηN3-u, N3 being the number of the drum pulses between the time points C and D, u being the number of the drum pulses between the time points C and U and η being the ratio of the space between the reference detecting point PC and a limit detecting point PD to the space between the reference detecting point PC and the reference re-accelerating point QC. When the paper end pulse X3 is detected after a time point D, the delay in conveyance of the printing paper cannot be compensated for. Accordingly the point PD corresponding to the time point D will be referred to as "the limit detecting point".

Figure 11:
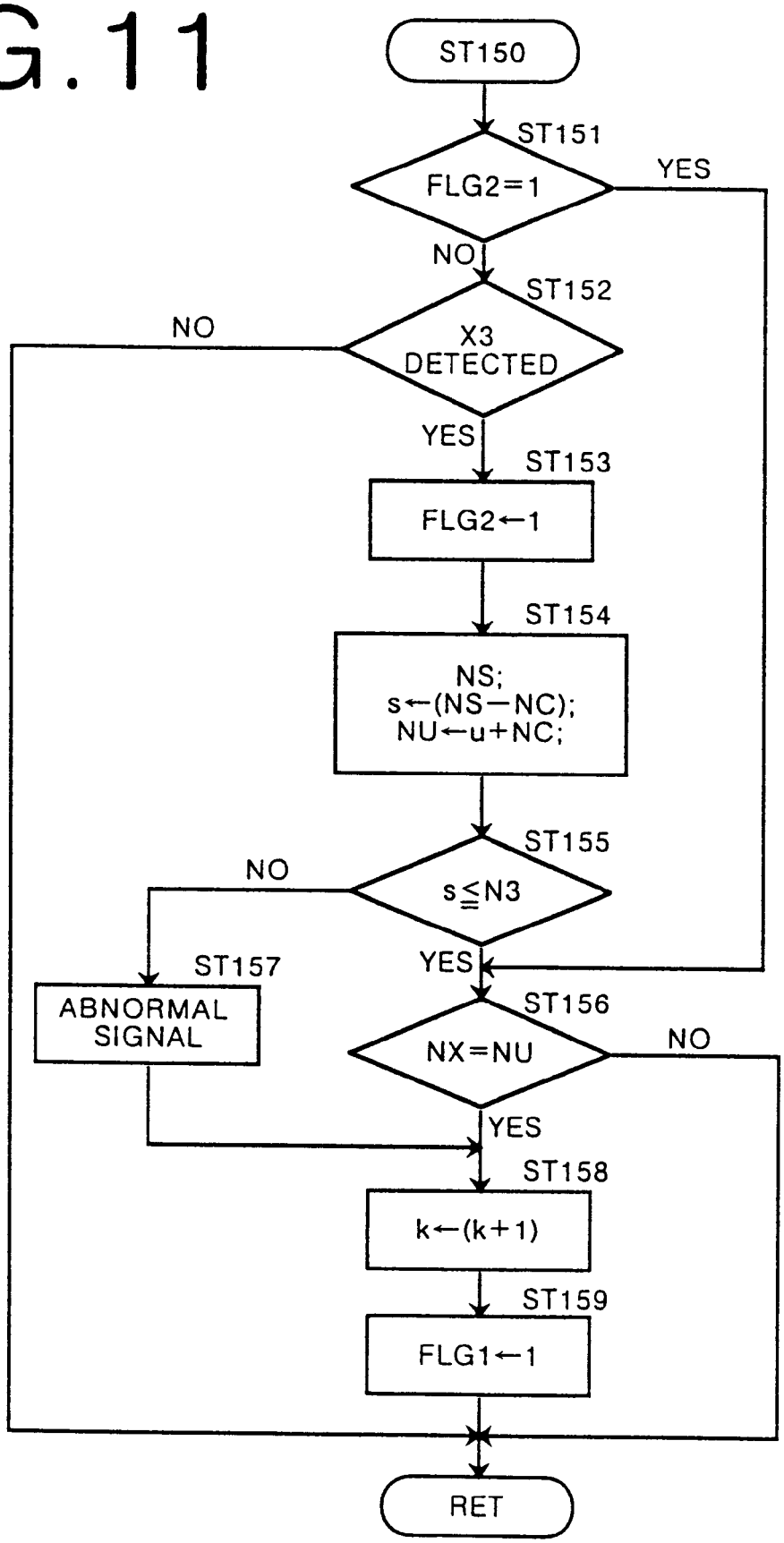
FIG. 11 is a flow chart for illustrating the slip compensation control.

In the slip compensation control sub-routine shown in FIG. 11, when the paper end pulse X3 is detected (step ST152: YES), the register flag FLG2 is set to 1 (step ST153) and then step ST154 is executed. In the step ST154, the re-accelerating point QS is calculated according to the time point at which the paper end pulse X3 is detected.

The space between the reference detecting point PC and the limit detecting point PD (the space between the time points C and D) is N3 (=ND−NC) in terms of the number of the drum pulses. The space between the reference detecting point PC and the reference re-accelerating point QC (the space between the time points C and E) is ηN3 in terms of the number of the drum pulses. Due to difference in the rotating speed between the printing drum 10 and the register motor 56, rotation of the register motor 56 lags behind the printing drum 10 by a distance of 1-(r/nk) pulses per one drum pulse. That is, in order for the register motor 56 to catch up with the printing drum 10, 1/(1-(r/nk) register pulses are required per one drum pulse. On the basis of this relation, a maximum amount of acceptable delay, that is, the space between the reference detecting point PC and the limit detecting point PD can be determined in terms of the number of the drum pulses. Thus the time point D can be determined and the time point E can be determined on the basis of the time point D and η.

When the paper end pulse X3 is detected at a time point S with a delay of s drum pulses (=NS−NC), the register motor 56 is caused to rise from a time point U along line QS-Q'S. The area of rectangle C-S-PS-PC represents the amount of slip of the printing paper between the time points B and C. That is, the area of rectangle C-D-PD-PC is equal to α(S)+β(S) and constant, wherein α(S) represents the area of rectangle S-D-PD-PS and β(S) represents the area of quadrangle QS-QC-Q'C-Q'S. Thus the number of drum pulses x between the time points U and E is determined as (η−1)s and the value NU of count NX at the time point U (corresponding to the re-accelerating point QS) is determined as u+NC, wherein u=ηN3-(η−1)s.

When the paper end pulse X3 is detected after the time point D corresponding to the limit detecting point PD, error procedure is executed (steps ST155 and ST157). Otherwise, when the drum counts NX reaches NU, the register motor 56 is re-accelerated. (steps ST156, ST158 and ST159)

By adjusting the re-accelerating point according to the amount of delay of conveyance of the printing paper, the leading end of the printing paper can meet the printing drum 10 constantly in the desired position, whereby position shift of the printing paper due to slip between the printing paper and the register rollers 51 and 52 can be prevented.

In steps ST200 and ST201, the width of the drum pulse $P_{d,i}$ (=X2) is converted to the width of the register pulse $P_{m,i}$ (=X5). This is for equalizing the distance of conveyance of the printing paper per one register pulse to the distance of rotation of the printing drum 10 per one drum pulse. For this purpose, the following formula should be satisfied;

$$2\pi Rd/Nd=\lambda'(2\pi Rm/Nm)\rightarrow P_{m,i}=\lambda P_{d,i}$$

wherein Rd represents the radius of the printing drum, Rm represents the radius of the register roller 52, Nd represents the resolution of the drum encoder, Nm represents the resolution of the register encoder, $\lambda'$ represents a $(P_{m,i} \rightarrow P_{d,i})$ conversion coefficient and $\lambda$ represents a $(P_{d,i} \rightarrow P_{m,i})$ conversion coefficient $(\lambda=1/\lambda')$ Then the register motor 56 is controlled so that the register pulses $P_{m,i}$ are generated for each rising step in a number which, when multiplied by the register pulse $P_{m,i}$, produces a value equal to the product of the number (W) of the converted drum pulses $\lambda P_{d,i}$ in the rising step and the register roller rising ratio k/n2. At this time, the frequency of the converted drum pulses $\lambda P_{d,i}$ is used as a rotating speed signal $\nu_{d,i}$ representing the rotating speed of the printing drum 10 and the number of the converted drum pulses $\lambda P_{d,i}$ is used as an angular position signal $\theta_{d,i}$ representing the angular position of the printing drum 10. The frequency of the register pulses $P_{m,i}$ is used as a rotating speed signal $\theta_{m,i}$ representing the rotating speed of the register motor 56 and the number of the register pulses $P_{m,i}$ is used as an angular position signal $\theta_{m,i}$ representing the angular position of the register motor 56. (step ST201)

When the angular position of the register motor 56 is represented by $\theta_{m,i}$[pulse], the target angular position of the register motor 56 to which the register motor 56 is to be rotated is represented by $\theta_{d,i}$[pulse], the speed control gain, i.e., the torque [N·m] which the register motor 56 generates per 1[pulse/s] is represented by Kn[N·m·s/pulse] and the position control gain, i.e., the torque [N·m] which the register motor 56 generates per 1[pulse] is represented by Kn[N·m·1/pulse], the torque to be generated by the register motor 56 $T_{i+1}$[N·m] is represented by the following formula.

$$T_{i+1}[N\cdot m]=Kn\cdot d(\theta_{d,i}-\theta_{m,i})/dt+Kp\cdot(\theta_{d,i}-\theta_{m,i})$$

Then the position difference $\Delta\theta_i(=\theta_{d,i}-\theta_{m,i})$ between the target angular position $\theta_{d,i}$ of the register motor 56 and the present angular position $\theta_{m,i}$ of the register motor 56 and the rotating speed difference $\Delta\nu_i(=d(\theta_{d,i}-\theta_{m,i})/dt=\nu_{d,i}-\nu_{m,i})$ are calculated (step ST202) and $Kn\cdot\Delta\nu_i+Kp\cdot\Delta\theta_i$ is calculated as an output torque command $T_{i+l}$ (step ST203).

On the basis of the output torque command $T_{i+1}$ thus obtained, the motor control circuit 140 controls the register motor 56 by way of the PWM signal generator 150 and the motor drive circuit 160 so that the register motor 56 is in a predetermined relation with the printing roller 10 with respect to the rotating speed and the angular position.

Thus the register motor 56 is accelerated to the rotating speed of the printing drum 10 while incrementing the number i of the drum pulses one by one (steps ST204 and ST205) and when the printing drum 10 is rotated to a position where the point G is just below the master sensor 30 (FIG. 3) (time point G), the register motor 56 is stopped (steps ST204 and ST206).

In the register motor control described above, since the register motor 56 is controlled on the basis of the position difference $\Delta\theta_i$ and the rotating speed difference $\Delta\nu_i$, position shift of the printing paper due to fluctuation in the rotating speed of the printing drum 10 and/or register rollers 51 and 52 can be prevented.

What is claimed is:

1. A stencil printer comprising a rotary printing drum which is provided with a master clamp mechanism for holding an end of a stencil master and around which the stencil master is wrapped, a printing drum drive means which rotates the printing drum, a press roller which is rotatable in parallel to the printing drum in contact with the printing drum, and a pair of opposed conveyor rollers which feed a printing paper between the printing drum and the press roller so that the leading end of the printing paper meets the printing drum in a predetermined position of the printing drum, wherein the improvement comprises a conveyor roller drive means which is provided separately from the printing drum drive means and drives the conveyor rollers, a reference position detecting means which detects a reference position on the printing drum, a printing drum rotation detecting means which detects rotation of the printing drum on the basis of the reference position detected by the reference position detecting means, a conveyor roller rotation detecting means which detects rotation of at least one of the conveyor rollers, and a conveyor roller control means which controls the conveyor roller drive means on the basis of the rotation of the printing drum detected by the printing drum rotation detecting means and the rotation of the conveyor roller detected by the conveyor roller rotation detecting means so that the leading end of the printing paper meets the printing drum in the predetermined position of the printing drum.

2. A stencil printer as defined in claim 1 in which the reference position detecting means detects a predetermined position of the stencil master wrapped around the printing drum.

3. A stencil printer as defined in claim 1 in which the printing drum rotation detecting means detects the angular position of the printing drum, the conveyor roller rotation detecting means detects the angular position of the conveyor roller, and the conveyor roller control means controls the conveyor roller drive means on the basis of a rotating speed and the angular position of the printing drum and a rotating speed and the angular position of the conveyor roller so that the leading end of the printing paper meets the printing drum in the predetermined position of the printing drum.

4. A stencil printer comprising a rotary printing drum which is provided with a master clamp mechanism for holding an end of a stencil master and around which the stencil master is wrapped, a printing drum drive means which rotates the printing drum, a press roller which is rotatable in parallel to the printing drum in contact with the printing drum, and a pair of opposed conveyor rollers which feed a printing paper between the printing drum and the press roller so that the leading end of the printing paper meets the printing drum in a predetermined position of the printing drum, wherein the improvement comprises a conveyor roller drive means which is provided separately from the printing drum drive means and drives the conveyor rollers, a reference position detecting means which detects a reference position on the printing drum, a printing drum rotation detecting means which detects the angular position of the printing drum on the basis of the reference position detected by the reference position detecting means, a conveyor roller rotation detecting means which detects the angular position of at least one of the conveyor roller pair, a paper end detecting means which detects the leading end of the printing paper conveyed by the conveyor rollers at a predetermined distance from the conveyor rollers located between the conveyor rollers and the press roller, and a conveyor roller control means which controls the conveyor roller drive means on the basis of a rotating speed and the angular position of the printing drum and a rotating speed and the angular position of the conveyor roller so that the leading end of the printing paper meets the printing drum in the predetermined position of the printing drum, wherein the conveyor roller control means starts the conveyor roller drive means at a first time point at which the printing drum is in a first angular position, accelerates the conveyor roller drive means up to a second time point, keeps the conveyor roller drive means at the speed at the second time point, starts to re-accelerate the conveyor roller drive means at a re-accelerating time point which is determined according to a time point at which the leading end of the printing paper is detected by the paper end detecting means, and accelerates the conveyor roller drive means to a speed equal to the rotating speed of the printing drum, the rate of acceleration of the conveyor roller drive means being determined on the basis of the rotating speed and the angular position of the printing drum at the first time point, and the re-accelerating time point being determined according to the space between the time point at which the leading end of the printing paper is detected by the paper end detecting means and a reference detecting time point at which the printing drum is in a second angular position at a distance from the first angular position corresponding to said predetermined distance from the conveyor rollers so that the re-accelerating time point is advanced from a reference re-accelerating time point, which has been set so that the leading end of the printing paper can meet the printing drum in the predetermined position when re-acceleration of the conveyor roller drive means is started at the reference re-accelerating time point so long as the leading end of the printing paper is detected at the reference detecting time point, by an amount which compensates for the delay in conveyance of the printing paper represented by the space between the reference detecting time point and the time point at which the leading end of the printing paper is detected, the second time point being set to be equal to or earlier than the reference detecting time point.

5. A stencil printer as defined in claim 4 in which the second time point is set equal to the reference detecting time point.

6. A stencil printer as defined in claim 4 in which the conveyor roller control means controls the conveyor roller drive means according to the following formula $$X=(\eta-1)s$$

wherein s represents said delay in conveyance of the printing paper, X represents the amount by which the re-accelerating time point is advanced from the reference re-accelerating time point, $\eta$ represents the ratio of the space between the reference detecting point and a limit detecting time point by which the leading end of the printing paper must be detected in order to compensate for the delay in conveyance of the printing paper to the space between the reference detecting point and the reference re-accelerating time point.

7. A stencil printer comprising a rotary printing drum which is provided with a master clamp mechanism for holding an end of a stencil master and around which the stencil master is wrapped, a press roller which is rotatable in parallel to the printing drum in contact with the printing drum, a pair of opposed conveyor rollers which feed a printing paper between the printing drum and the press roller, a conveyor roller drive means which starts to rotate the conveyor rollers upon receipt of a start signal which is generated with the leading end of a printing paper conveyed from a paper supply section in abutment against one of the conveyer rollers near the contact line of the rollers, a printing drum rotation detecting means which detects the angular position of the printing drum, a reference position detecting means which detects a reference position on the stencil master on the printing drum, and a conveyor roller control means which generates the start signal when the printing drum is rotated by a predetermined angle from the time at which the reference position is detected by the reference position detecting means.

8. A stencil printer as defined in claim 6 in which the conveyor roller control means is arranged so that said predetermined angle can be changed through an external input means.

9. A stencil printer comprising a rotary printing drum which is provided with a master clamp mechanism for holding an end of a stencil master and around which the stencil master is wrapped, a printing drum drive means which rotates the printing drum, a press roller which is rotatable in parallel to the printing drum in contact with the printing drum, and a pair of opposed conveyor rollers which feed a printing paper between the printing drum and the press roller so that the leading end of the printing paper meets the printing drum in a predetermined position of the printing drum, wherein the improvement comprises a conveyor roller drive means which is provided separately from the printing drum drive means and drives the conveyor rollers, a reference position detecting means which detects a reference position on the printing drum, a printing drum rotation detecting means which detects the angular position of the printing drum on the basis of the reference position detected by the reference position detecting means, a conveyor roller rotation detecting means which detects the angular position of at least one of the conveyor roller pair, a paper end detecting means which detects the leading end of the printing paper conveyed by the conveyor rollers at a predetermined distance from the conveyor rollers located between the conveyor rollers and the press roller, and a conveyor roller control means which controls the conveyor roller drive means on the basis of a rotating speed and the angular position of the printing drum and a rotating speed and the angular position of the conveyor roller so that the leading end of the printing paper meets the printing drum in the predetermined position of the printing drum, wherein the conveyor roller control means starts the conveyor roller drive means at a first time point at which the printing drum is in a first angular position, accelerates the conveyor roller drive means up to a second time point, keeps the conveyor roller drive means at the speed at the second time point, starts to re-accelerate the conveyor roller drive means at a re-accelerating time point which is determined according to a space between the first time point and a time point at which the leading end of the printing paper is detected by the paper end detecting means, and accelerates the conveyor roller drive means to a speed equal to the rotating speed of the printing drum, the rate of acceleration of the conveyor roller drive means being determined on the basis of the rotating speed and the angular position of the printing drum at the first time point.

* * * * *